US008806911B2

(12) United States Patent
Huang

(10) Patent No.: US 8,806,911 B2
(45) Date of Patent: Aug. 19, 2014

(54) KEYBOARD COVER FABRICATION METHOD

(71) Applicant: Chi-Jui Huang, New Taipei (TW)

(72) Inventor: Chi-Jui Huang, New Taipei (TW)

( * ) Notice: Subject to any disclaimer, the term of this patent is extended or adjusted under 35 U.S.C. 154(b) by 0 days.

(21) Appl. No.: 14/026,059

(22) Filed: Sep. 13, 2013

(65) Prior Publication Data

US 2014/0076019 A1 Mar. 20, 2014

(30) Foreign Application Priority Data

Sep. 14, 2012 (TW) ..... 101133685 A

(51) Int. Cl.
*B21D 26/02* (2011.01)
*H01H 9/02* (2006.01)

(52) U.S. Cl.
CPC ..... *H01H 9/02* (2013.01)
USPC ..... 72/60; 72/324; 72/385; 29/421.1

(58) Field of Classification Search
CPC ..... B21D 26/02; B21D 26/021; B21D 26/027
USPC ..... 72/57, 60, 61, 324, 325, 334, 337, 72/379.6, 385; 29/421.1, 896.6
See application file for complete search history.

(56) References Cited

U.S. PATENT DOCUMENTS

| | | | | |
|---|---|---|---|---|
| 1,959,101 | A * | 5/1934 | Hasselquist | 72/327 |
| 2,070,784 | A * | 2/1937 | Cox | 72/334 |
| 2,238,037 | A * | 4/1941 | Cornell, Jr. | 72/58 |
| 3,938,963 | A * | 2/1976 | Hale | 428/582 |
| 4,077,247 | A * | 3/1978 | Stewart | 72/325 |
| 4,111,028 | A * | 9/1978 | Kupsky | 72/324 |
| 4,191,039 | A * | 3/1980 | Bradbury | 72/60 |
| 4,788,843 | A * | 12/1988 | Seaman et al. | 72/58 |
| 5,895,698 | A * | 4/1999 | Cacciatore et al. | 206/525 |
| 6,938,449 | B2 * | 9/2005 | Kusunoki et al. | 72/57 |
| 7,069,763 | B2 * | 7/2006 | Cook et al. | 72/334 |
| 2012/0297558 | A1 * | 11/2012 | Wang et al. | 72/324 |

* cited by examiner

*Primary Examiner* — David B Jones
(74) *Attorney, Agent, or Firm* — Chun-Ming Shih

(57) ABSTRACT

A keyboard cover fabrication method for making a keyboard cover by processing a metal sheet material into a shaped metal component having protrusions and then cutting off a top part of each protrusion of the shaped metal component.

5 Claims, 4 Drawing Sheets

KEYBOARD COVER FABRICATION METHOD

FIELD OF THE INVENTION

The present invention relates to a method for fabricating a keyboard cover and more particularly, to a method for fabricating a metal keyboard cover.

BACKGROUND OF THE INVENTION

With big and fast global selling of 3C-information products and high-end home appliances, metal casing has already become the basic part of many products.

In general, in addition to the characteristics of high strength and noble quality, metal casing offers better heat dissipation, preventing the shortening of the lifespan of electronic components due to a high temperature.

However, due to structural constraints, some device casings cannot be directly made out of a metal sheet material. FIG. 1 illustrates the fabrication of a metal keyboard cover according to the prior art. As illustrated, a stamp forming technique and a plastic injection molding technique are employed to form a plurality of through holes 121 in a metal sheet material 12 and to make a plurality of mating stub tubes 14 respectively, and then the mating stub tubes 14 are respectively bonded to the top wall of the metal sheet material 12 around each through hole 121, and thus a keyboard cover 16 is obtained.

The keyboard cover 16 thus made comprises a planar body part 161, a plurality of key-switch holes 163 cut through the planar body part 161, and a flange 165 located at the planar body part 161 around each key-switch hole 163.

The aforesaid keyboard cover 16 is made by bonding separately made components together. In addition to the problem of discontinuous material at the junction, the bonding quality also determines the durability of the product. Further, under the effects of climate and temperature changes, the components of the keyboard cover may drop off easily.

SUMMARY OF THE PRESENT INVENTION

It is, therefore, the main object of the present invention to provide a keyboard cover fabrication method, which is specifically designed for making metal keyboard covers.

It is another object of the present invention a keyboard cover fabrication method, which fabricates metal keyboard covers using a compression molding technique.

The present invention provides a keyboard cover fabrication method, comprising the steps of: providing a metal sheet material; employing a predetermined technique to process said metal sheet material into a shaped metal component having a plurality of protrusions; and cutting off a top part of each said protrusion of said shaped metal component, thereby forming a keyboard cover.

In one embodiment of the present invention, wherein said predetermined technique is compression molding.

In one embodiment of the present invention, wherein the application of said compression molding comprises the steps of: providing a mold comprising a sealing die defining therein a sealing cavity and at least one inlet and a shape forming die defining therein a shape forming cavity; providing at least one heater for heating said mold; placing said metal sheet material in between said shape forming die and said sealing die of said mold; and connecting at least one fluid supply source to said inlet of said sealing die and then operating said fluid supply source to provide a high pressure fluid through said at least one inlet into said sealing cavity to give a fluid pressure to said metal sheet material, deforming said metal sheet material and forcing said metal sheet material against an inside wall of said shape forming cavity so that said metal sheet material is molded into a shaped metal component having a plurality of protrusions.

In one embodiment of the present invention, wherein said high pressure fluid is selected from the group of a liquid, a gas, an inert gas, and their combinations.

In one embodiment of the present invention, wherein the step of cutting off a top part of each said protrusion of said shaped metal component is achieved using one of the techniques of stamp forming, cutting crown molding and milling molding.

In one embodiment of the present invention, wherein said metal sheet material is selected from the group of stainless steel, copper, aluminum, magnesium alloy, titanium alloy, aluminum-magnesium alloy, nickel-base superalloys, tungsten, molybdenum, and cobalt.

In one embodiment of the present invention, wherein the fabricated keyboard cover is a one-piece member.

DETAILED DESCRIPTION OF THE PREFERRED EMBODIMENTS

Figure 1:
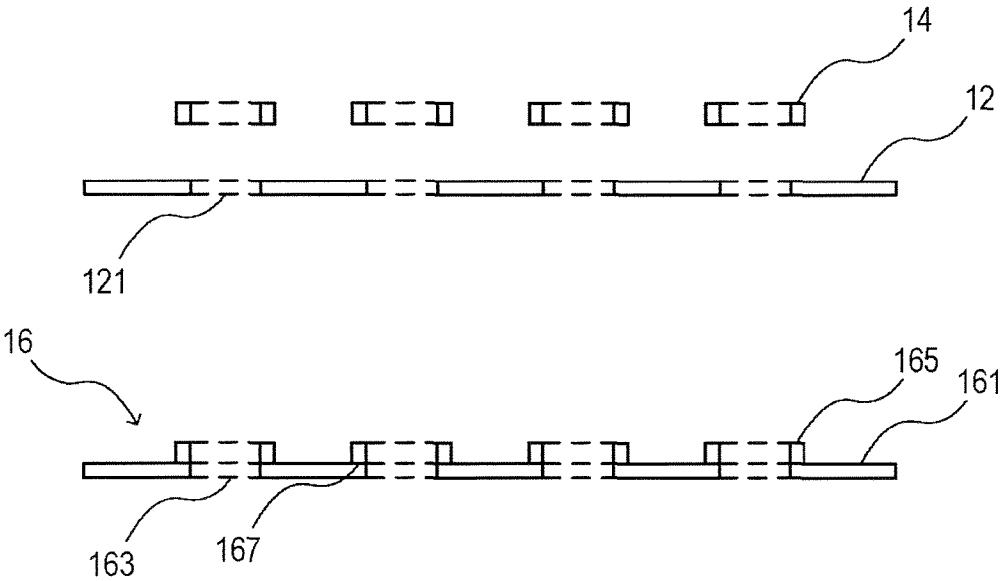
FIG. 1 is a schematic drawing illustrating the fabrication of a metal keyboard cover according to the prior art.
Figure 2:
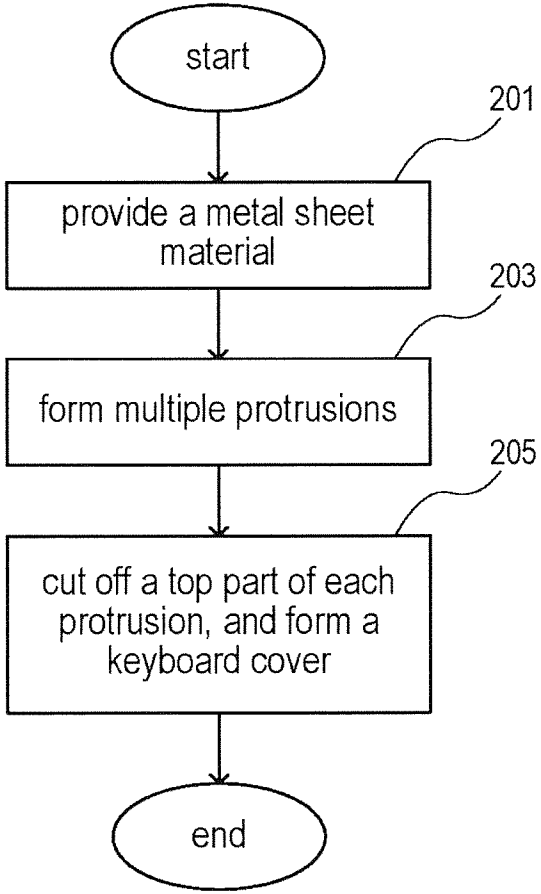
FIG. 2 is a flow chart of a keyboard cover fabrication method in accordance with the present invention.

Please refer to FIG. 2, a flow chart of a keyboard cover fabrication method in accordance with the present invention is shown. As illustrated, the keyboard cover fabrication method comprises the steps of:

Step 201: providing a metal sheet material, where the metal sheet material can be selected from the material group of stainless steel, copper, aluminum, magnesium alloy, titanium alloy, aluminum-magnesium alloy, nickel-base superalloys, tungsten, molybdenum, or cobalt;

Step 203: employing a predetermined technique, for example, compression molding, to process the metal sheet material into a shaped metal component having a plurality of protrusions; and Step: 205: cutting off a top part of each of the protrusions of the shaped metal component, thereby obtaining a finished one-piece metal keyboard cover.

Figure 3:
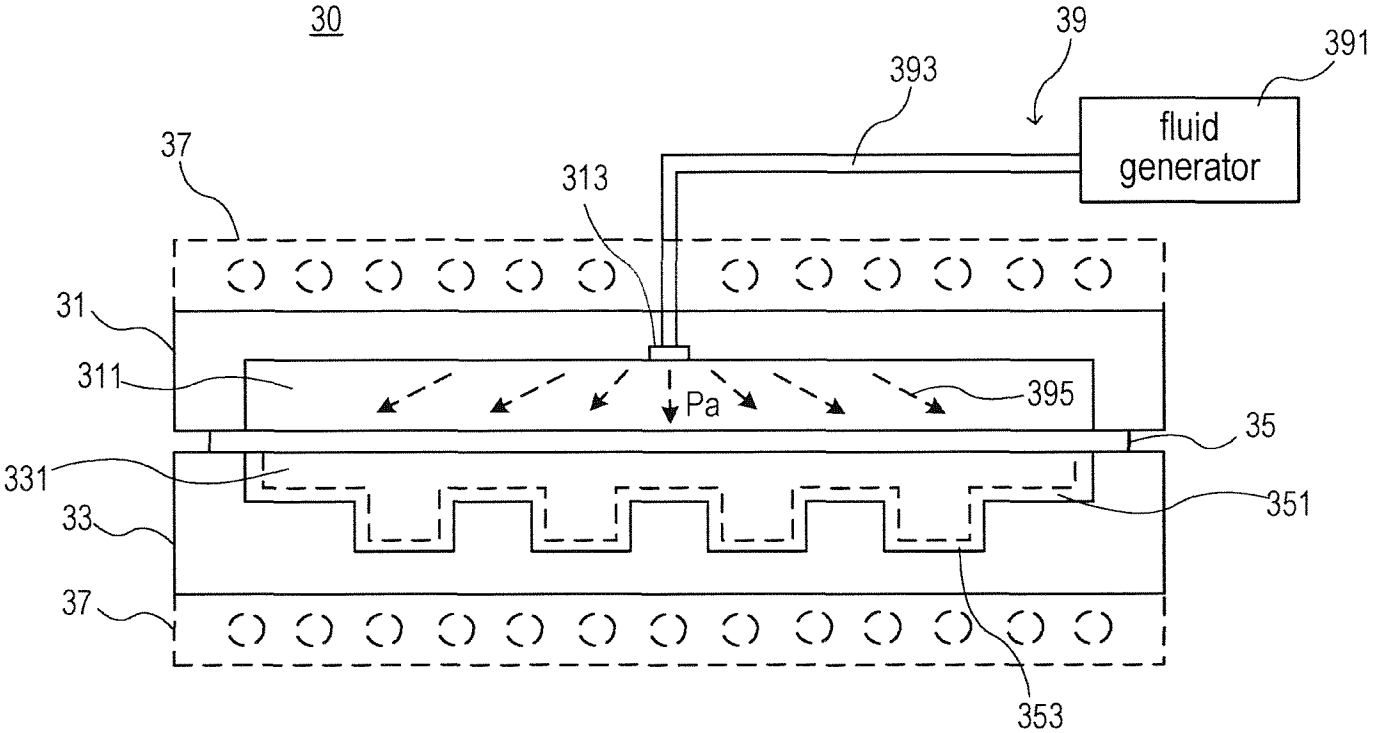
FIG. 3 is a schematic drawing illustrating the fabrication of a keyboard cover subject to the keyboard cover fabrication method in accordance with the present invention (I).
Figure 4:
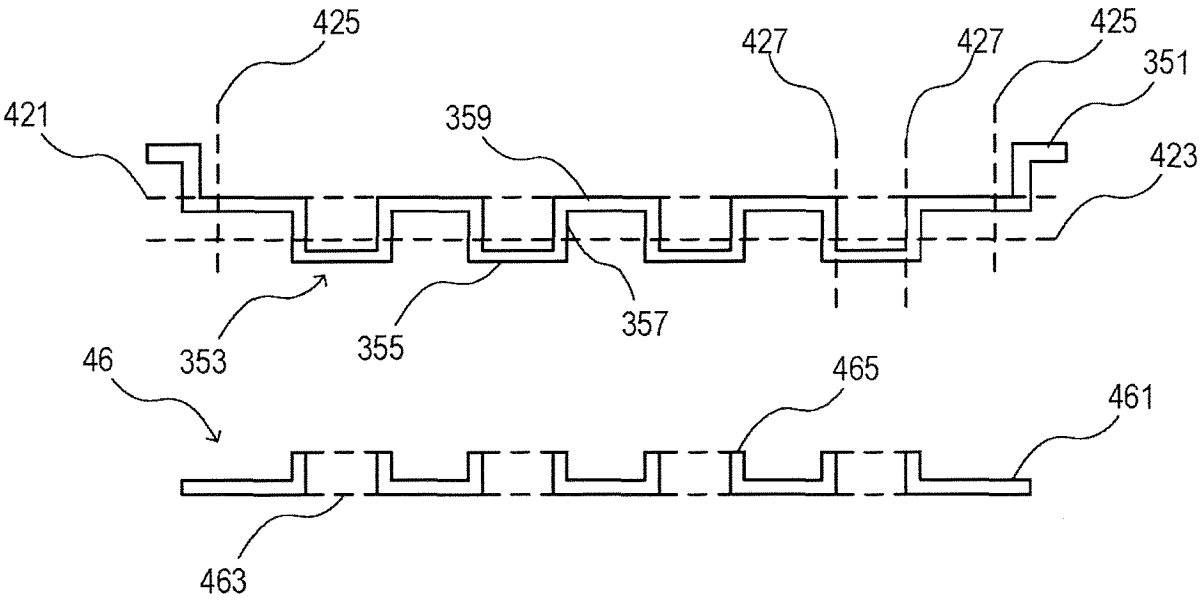
FIG. 4 is a schematic drawing illustrating the fabrication of a keyboard cover subject to the keyboard cover fabrication method in accordance with the present invention (II).

FIG. 3 and FIG. 4 illustrate the performance of the steps of the keyboard cover fabrication method. As illustrated, a compression molding technique is employed to mold the prepared metal sheet material 35 into a shaped metal component having a plurality of protrusions 353.

The aforesaid compression molding technique is performed using a metal sheet material shape forming system 30, which comprises a sealing die 31, a shape forming die 33, one or a plurality of heaters 37, and one or a plurality of fluid supply sources 39.

The sealing die 31 defines therein at least one sealing cavity 311, and one or a plurality of inlets 313. The shape forming die 33 defines therein at least one shape forming cavity 331.

The heater 37 is adapted to heat the sealing die 31 and the shape forming die 33, and can heat the metal sheet material 35 directly or indirectly. The fluid supply source 39 comprises a fluid generator 391 for generating a high pressure fluid 395, and a delivery pipe 393 adapted to guide the generated high pressure fluid 395 from the fluid generator 391 through the inlet 313 of the sealing die 31 into the sealing cavity 311.

During application of the compression molding process, provide a metal sheet material 35 and place the metal sheet material 35 in between the sealing die 31 and the shape forming die 33. Thereafter, operate the heater 37 to heat the metal sheet material 35, either directly or indirectly, to a predetermined temperature level, thereby softening the metal sheet material 35. When the metal sheet material 35 is softened, operate the fluid generator 391 of the fluid supply source 39 to provide a high pressure fluid 395 through the delivery pipe 393 into the sealing cavity 311 via the inlet 313 of the sealing die 31, giving a fluid pressure Pa to the metal sheet material 35. Subject to the effect of the fluid pressure Pa, the metal sheet material 35 is deformed and forced into close contact with the inside wall of the shape forming cavity 331, forming a shaped metal component 351 having a plurality of protrusions 353, as shown in FIG. 3.

In this embodiment, directly heating the metal sheet material 35 means: operate the heater 37 to directly heat the metal sheet material 35 to the predetermined temperature level; indirectly heating the metal sheet material 35 means: operate the heater 37 to preheat the mold (i.e., the sealing die 31 and the shape forming die 33), and then put the metal sheet material 35 between the sealing die 31 and the shape forming die 33 and keep operating the heater 37 to heat the mold, enabling the metal sheet material 35 to be heated by the temperature of the sealing die 31 and the shape forming die 33 to the predetermined temperature level. Further, the aforesaid high pressure fluid 395 can be a liquid, gas, inert gas, or one of their combinations.

After the shaped metal component 351 is obtained, start a cutting step to cut off unnecessary part from the shaped metal component 351, and thus a finished keyboard cover 46 is obtained. This cutting step can be done using a milling molding technique or cutting crown molding technique. When applying a milling molding technique or cutting crown molding technique, operate the cutting tool along a first cutting line 421 and a second cutting line 423 to cut off the border area of the shaped metal component 351 and a top part 355 of each protrusion 353 from the shaped metal component 351, maintaining the planar body part 359 and the peripheral wall 357 of each protrusion 353. Alternatively, a stamp forming technique can be employed to cut along a third cutting line 425 and a fourth cutting line 427, removing the border area of the shaped metal component 351 and a top part 355 of each protrusion 353 from the shaped metal component 351, maintaining the planar body part 359 and the peripheral wall 357 of each protrusion 353.

After formation, the keyboard cover 46 comprises a planar body part 461, a plurality of key-switch holes 463 cut through the planar body part 461, and a flange 465 located at the planar body part 461 around each key-switch hole 463.

Thus, employing the keyboard cover fabrication method of the present invention can fabricate one-piece keyboard covers efficiently.

The foregoing description is merely embodiments of the present invention and not considered as restrictive. All equivalent variations and modifications in shape, structure, feature, and spirit in accordance with the appended claims may be made without departing from the scope of the invention.

What is claimed is:

1. A keyboard cover fabrication method, comprising steps of:

providing a metal sheet material;

employing a compression molding technique to process said metal sheet material into a shaped metal component having a plurality of protrusions; and removing a top portion of each said protrusion of said shaped metal component, thereby forming a key board cover;

wherein the compression molding technique comprises the steps of:

providing a mold comprising a sealing die defining therein a sealing cavity and at least one inlet and a shape forming die defining therein a shape forming cavity;

providing at least one heater for heating said mold;

placing said metal sheet material in between said shape forming die and said sealing die of said mold; and connecting at least one fluid supply source to said inlet of said sealing die and then operating said fluid supply source to provide a high pressure fluid through said at least one inlet into said sealing cavity to give a fluid pressure to said metal sheet material, deforming said metal sheet material and forcing said metal sheet material against an inside wall of said shape forming cavity so that said metal sheet material is molded into a shaped metal component having a plurality of protrusions.

2. The keyboard cover fabrication method as claimed in claim 1, wherein said high pressure fluid is selected from the group consist of a liquid, a gas, an inert gas, and the combination thereof.

3. The keyboard cover fabrication method as claimed in claim 1, wherein the step of removing a top portion of each said protrusion of said shaped metal component is achieved by using one of the techniques of stamp forming, cutting and milling.

4. The keyboard cover fabrication method as claimed in claim 1, wherein said metal sheet material is selected from the group consist of stainless steel, copper, aluminum, magnesium alloy, titanium alloy, aluminum-magnesium alloy, nickel-base superalloys, tungsten, molybdenum, and cobalt.

5. The keyboard cover fabrication method as claimed in claim 1, wherein the fabricated keyboard cover is a one-piece member.

* * * * *